US007083235B2

(12) United States Patent
Grimm et al.

(10) Patent No.: US 7,083,235 B2
(45) Date of Patent: Aug. 1, 2006

(54) CONVERTIBLE PIECE OF UPHOLSTERED FURNITURE WITH CHAIR AND BED FUNCTION

(75) Inventors: Eberhard Grimm, Quersa (DE); Hans Fiedler, Schmiedeweg 7, D-047396 Waldheim (DE); Karl Becher, Freital (DE)

(73) Assignee: Hans Fiedler, Waldheim (DE)

( * ) Notice: Subject to any disclaimer, the term of this patent is extended or adjusted under 35 U.S.C. 154(b) by 0 days.

(21) Appl. No.: 10/868,460

(22) Filed: Jun. 10, 2004

(65) Prior Publication Data

US 2005/0052067 A1 Mar. 10, 2005

(30) Foreign Application Priority Data

Sep. 8, 2003 (DE) ..... 103 41 238

(51) Int. Cl.
*A47C 7/50* (2006.01)
*A47C 20/00* (2006.01)

(52) U.S. Cl. ..... 297/423.21; 297/423.24; 297/71

(58) Field of Classification Search ..... 297/71, 297/118, 408, 423.2, 423.21, 423.22, 423.23, 297/423.24; 5/18.1, 927, 616, 618
See application file for complete search history.

(56) References Cited

U.S. PATENT DOCUMENTS

| | | | | |
|---|---|---|---|---|
| 507,270 | A * | 10/1893 | Hirschfeld | 297/423.22 |
| 2,328,411 | A * | 8/1943 | Bergstrom | 5/48 |
| 2,526,623 | A * | 10/1950 | Maurer | 297/88 |
| 3,596,984 | A * | 8/1971 | Jones et al. | 297/105 |
| 4,099,275 | A * | 7/1978 | Pallan | 5/18.1 |
| 4,108,491 | A | 8/1978 | Rogers, Jr. | |
| 4,402,096 | A * | 9/1983 | Atimichuk | 5/17 |
| 4,563,784 | A * | 1/1986 | Shrock et al. | 5/18.1 |
| 4,601,074 | A * | 7/1986 | Welsch et al. | 5/17 |
| 4,860,393 | A * | 8/1989 | Schefthaler | 5/18.1 |
| 5,011,220 | A | 4/1991 | LaPointe | |
| 5,098,158 | A | 3/1992 | Palarski | |
| 5,682,629 | A | 11/1997 | Bortoluzzi | |
| 5,779,310 | A * | 7/1998 | Suskey et al. | 297/118 |
| 6,588,837 | B1 * | 7/2003 | Schultz et al. | 297/118 |
| 2002/0162170 | A1 * | 11/2002 | Dewert | 5/616 |

FOREIGN PATENT DOCUMENTS

| | | |
|---|---|---|
| DE | 835 334 C | 3/1952 |
| DE | 28 17 379 | 10/1978 |
| DE | 39 15 947 | 1/1990 |
| DE | 40 30 641 | 4/1991 |
| DE | 94 08 283 | 8/1994 |
| DE | 295 02 827.0 | 6/1995 |

(Continued)

*Primary Examiner*—Anthony D. Barfield
(74) *Attorney, Agent, or Firm*—Collard & Roe, P.C.

(57) ABSTRACT

A convertible piece of upholstered furniture can be converted via motorized conversion aids from a seat function into a bed, by way of any desired number of intermediate stages, and vice versa. All movable parts can be fully stressed by a person during conversion, even when a person is sitting or lying on the piece of furniture. These changes can take place even when the piece is being used by a person, whereby each movable part of the piece of upholstered furniture can be changed by means of a motor drive having a control. The footrest and the seat part are configured so that they can move out of a base frame with their metal fittings. A lever construction arranged on the metal fitting of the footrest and a motor drive adjusts the height and angle of the footrest and moves the piece of furniture to the various positions.

10 Claims, 6 Drawing Sheets

FOREIGN PATENT DOCUMENTS

| | | |
|---|---|---|
| DE | 296 02 331 | 1/1996 |
| DE | 298 08 149 | 7/1998 |
| DE | 200 09 447 | 10/2001 |
| DE | 201 16 145 | 1/2002 |
| DE | 100 44 629 | 4/2002 |
| DE | 202 15 899 | 1/2003 |
| EP | 0 736 274 | 3/1996 |

* cited by examiner

CONVERTIBLE PIECE OF UPHOLSTERED FURNITURE WITH CHAIR AND BED FUNCTION

CROSS REFERENCE TO RELATED APPLICATIONS

Applicants claim priority under 35 U.S.C. §119 of German Application No. 103 41 238.7 filed Sep. 8, 2003.

BACKGROUND OF THE INVENTION

1. Field of the Invention

The present invention relates to the production of upholstered furniture. In particular, the present invention relates to a convertible piece of upholstered furniture, in which the upholstered parts, namely the seat, the backrest, the headrest and the footrest, can be adjusted in an infinitely adjustable manner. The backrest with the headrest can be adjusted without touching the wall. Adjustment takes place by means of appropriate arrangements of metal fittings and motorized conversion aids.

2. The Prior Art

A piece of furniture for sitting that can be converted into a piece of furniture for lying down is already known in many different embodiments. Moving out or adjusting a footrest on a piece of furniture for sitting has also already been described in many different designs. For example, in DE 28 17 379 A1, DE 39 15 947 C2, or DE 200 09 447 U1, designs similar to a slidable lattice gate are proposed for moving the footrest out of a piece of upholstered furniture. Of course these designs can be supplemented by a motor drive, but all of them possess the disadvantage that because of the lack of perpendicular support down to the floor, they cannot withstand much weight stress when the footrest is moved out. The design of the footrest according to DE 201 16 145 U1 is also similar.

In the case of DE 202 15 899 U1, the footrest can be pulled out and adjusted to the seat height. The seat part can also be pulled out of a base frame. The backrest is brought into a lying position by means of a drag fitting. All of these changes in position are possible only by hand, when the piece of furniture is not being used. The design according to DE 40 30 641 A1 is also similar.

The device according to DE 295 02 827 U1 also encompasses a seat part and a footrest that can be pulled out. The backrest is attached to the seat part. When the seat part is pulled out, the backrest is pulled into a horizontal position and serves as the headrest. The footrest possesses a lever construction, below the upholstery, which allows a height adjustment. But here again, this adjustment is possible only by means of manual operation.

In DE 296 02 331 U1, a footrest is arranged under the seat area, which can be pulled out and adjusted in a restricted range of angles.

In EP 0 736 274 B1, a piece of furniture for sitting is described, which can be converted into a piece of furniture for lying down, by way of an intermediate position. In the intermediate position, the seat area and the footrest are at a slight angle relative to one another.

SUMMARY OF THE INVENTION

It is an object of the present invention to provide a convertible piece of upholstered furniture that can be converted from a seat function into a bed, by way of any desired number of intermediate stages, and vice versa, by means of motorized conversion aids, in which all the movable parts can be fully stressed by a person and the conversion is possible even when a person is sitting or lying on the piece of furniture.

The convertible piece of upholstered furniture has an easy, step-less and wall-free conversion capability. By means of electric drives, it is possible to adjust the individual sitting positions continuously without steps, all the way to a lying position, even in use. In this connection, the user does not have to get up from the chair or, if it is being used as a chaise lounge or bed, from the chaise lounge. This advantage is particularly noteworthy in the case of older or handicapped persons. In the conversion into a bed function, the convertible piece of upholstered furniture does not possess any gaps between the individual parts, namely the backrest, the seat, and the footrest. All parts that can be moved out are covered with upholstery or other decorative elements, so that no metal fittings or drive elements can be seen and so that it is not possible to put one's hands into moving parts. Therefore possibilities of injury are precluded. In the conversion into a chair, all parts that move out are accommodated within the chair and covered, so that the conversion function of the chair is not evident. The design also permits full stress by a person on the footrest that has been moved out. The convertible piece of upholstered furniture can be an individual piece of furniture or integrated into a seating group.

Advantageous exemplary embodiments of the convertible piece of upholstered furniture are discussed below.

In one embodiment, the metal fittings are configured so that the footrest and the seat part, with their metal fittings, can be moved out of a base frame.

According to a further-embodiment, the footrest is adjustable in height and angle by means of a lever construction that is arranged on the metal fitting of the footrest and by means of a motor drive. The footrest can be moved out first into a slanted position and subsequently, without steps, into a horizontal position, up to the seat height, and furthermore into a position in which the footrest is slanted slightly upward, by means of a lever construction and a motor drive. In this way, any desired position of rest can be set, particularly for the legs of the person using the piece of furniture. Furthermore, because of the mechanical structure and the support on the floor, the footrest is able to withstand very great stress. The footrest can easily be used as a seating surface.

According to a further embodiment, the backrest can be moved down, without touching the wall, and the footrest, the seat part, and the backrest, in their end position, form the horizontal lying surface, without interstices or gaps between the individual parts. The conversion takes place in a continuous or step-less manner, by means of the motor drives, i.e. any desired intermediate position can be set. Conversely, the reverse process in an opposite sequence is also possible in the conversion from a chaise lounge to a chair.

In a further embodiment, the backrest possesses a separate headrest, which is continuously adjustable from a zero position, both in a positive and in a negative direction.

According to a further embodiment, the metal fitting of the footrest plus the upholstery is structured so that it can move out of the metal fitting of the seat part, and the metal fitting of the seat part is structured so that it can move out of the base frame, both at the same time. The metal fittings of the footrest and the seat part each possess support wheels on all four lower corners. The front support wheels, in each instance, stand on the floor, and the rear support wheels of the footrest are guided in guide rails of the seat part. The rear support wheels of the seat part are guided in guide rails of the base frame. The guide rails are arranged parallel to the side parts of the piece of upholstered furniture.

In a further embodiment, the lever construction of the footrest has bracket elements that move like scissors, for the height and angle adjustment. The two bracket elements are mounted at the ends, preferably made of flat material, on both outer sides of the upholstered chair, in each instance, whereby the bottom bracket elements each possess a connection by means of profile material, to the other side and the analogous bracket elements located there. Between these two connections, a motor having a telescoping cylinder is arranged.

The top ends of the bracket elements are mounted in a support frame for the upholstery of the footrest, and the bottom ends of the bracket elements are mounted in the metal fittings of the footrest.

In one configuration of the lever construction, trapezoid-shaped stops are arranged between the bottom bearing points of the bracket elements in the metal fitting of the footrest and between the top bearing points of the bracket elements on the support frame for the upholstery of the footrest.

A tension spring may be arranged between the support frame for the upholstery of the footrest and the metal fitting of the footrest.

One of the top bracket elements may have an extension to the metal fitting of the footrest as a stop, and the metal fitting of the footrest may have a counter-stop at the corresponding location, when the lever construction is moved out to its maximum position.

These configurations of individual elements of this lever construction serve to increase the safety of the operation of the lever construction. Also to increase the safety, particularly to prevent anyone from reaching into the lever construction, and also in order to improve the appearance when the piece of upholstered furniture is in the moved-out position, the sides of the footrest are covered with a bellows between the upholstery and the metal fitting.

According to a further embodiment, the backrest is held on the seat part and on the base frame by means of two angled boomerang-like flat metal parts, and thereby can perform the wall-free movement. The parts are mounted on the fitting of the seat part and on the base frame, on the right and the left in the side region of the piece of upholstered furniture in each instance, both of which are mounted on a common point on the outside of the backrest.

In a further embodiment, the backrest possesses a headrest that is adjustable by means of a motor, by way of a bracket. The backrest is attached at the bottom frame of the headrest. The headrest is held on the backrest by means of at least one hinge. The hinge(s) is attached at the side of the frame that stands higher in the direction of the seat part. For this purpose, the backrest possesses a frame, at its upper end, which forms an angle relative to the base of the base frame. Because of this angle formation, and by means of a motor that drives a pinion which engages an axle carried by the free end of the bracket, the headrest can be brought into a positive and a negative position. In the case of a variant with arm rests, according to a further embodiment, these arm rests are attached on the seat part and project beyond the backrest, towards the back, in the chair position. In this way, the displacement of the seat part relative to the backrest is equalized during the conversion to a chaise lounge, and the arm rests still perform their function even in a very flat position of the backrest.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
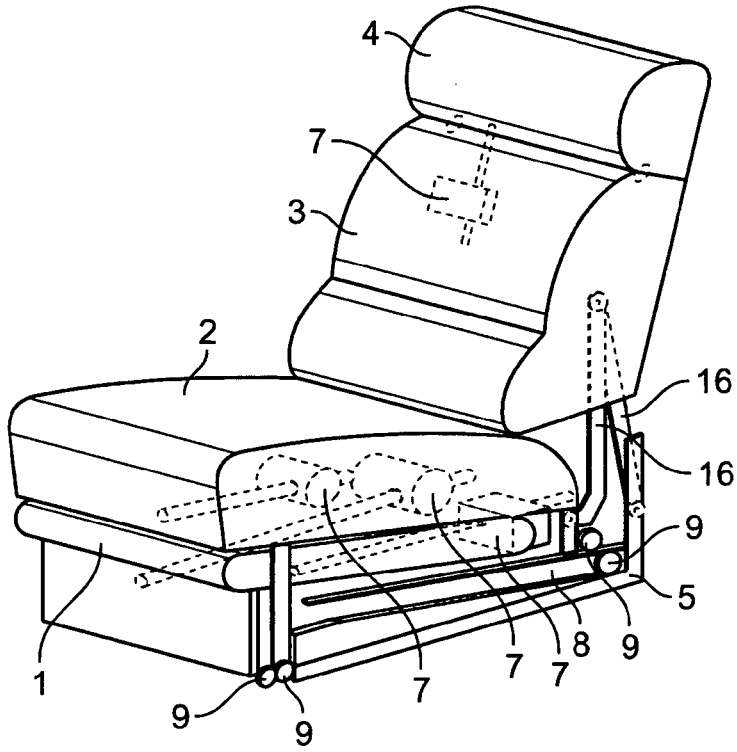
FIG. 1 shows an embodiment of the piece of upholstered furniture according to the invention with the footrest and seat part fully moved in, and a slightly slanted position of the backrest.
Figure 2:
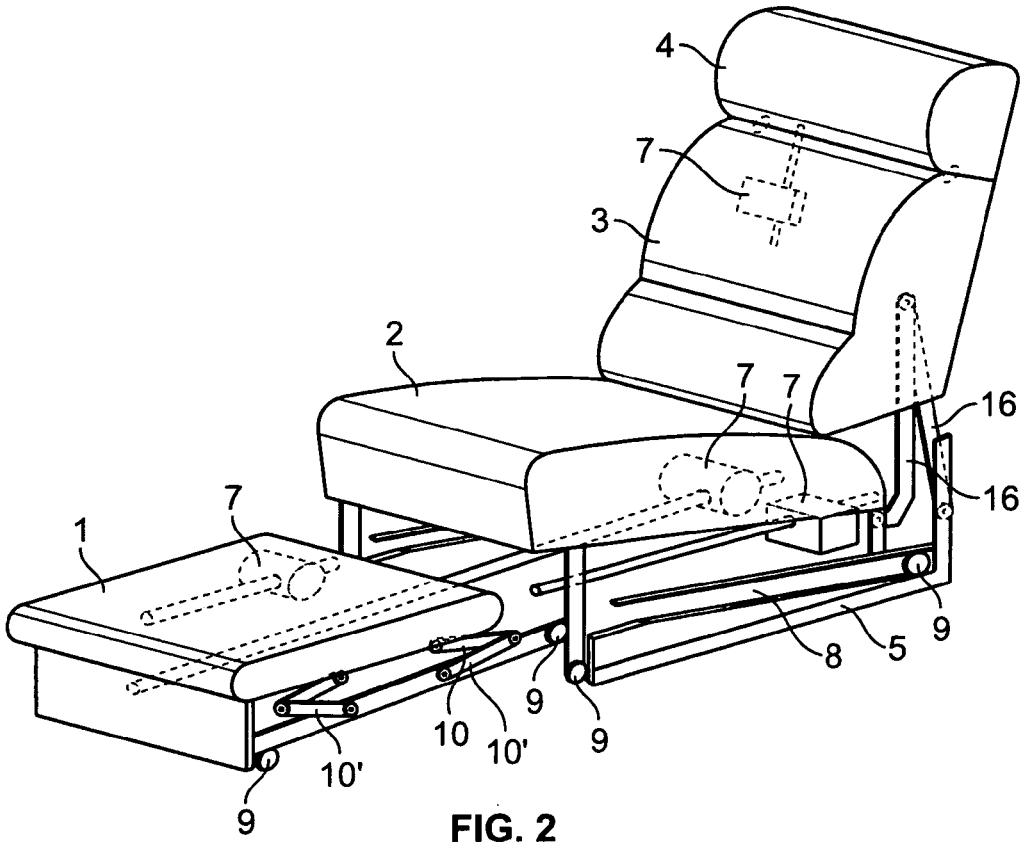
FIG. 2 shows the piece of upholstered furniture with the footrest moved out.
Figure 3:
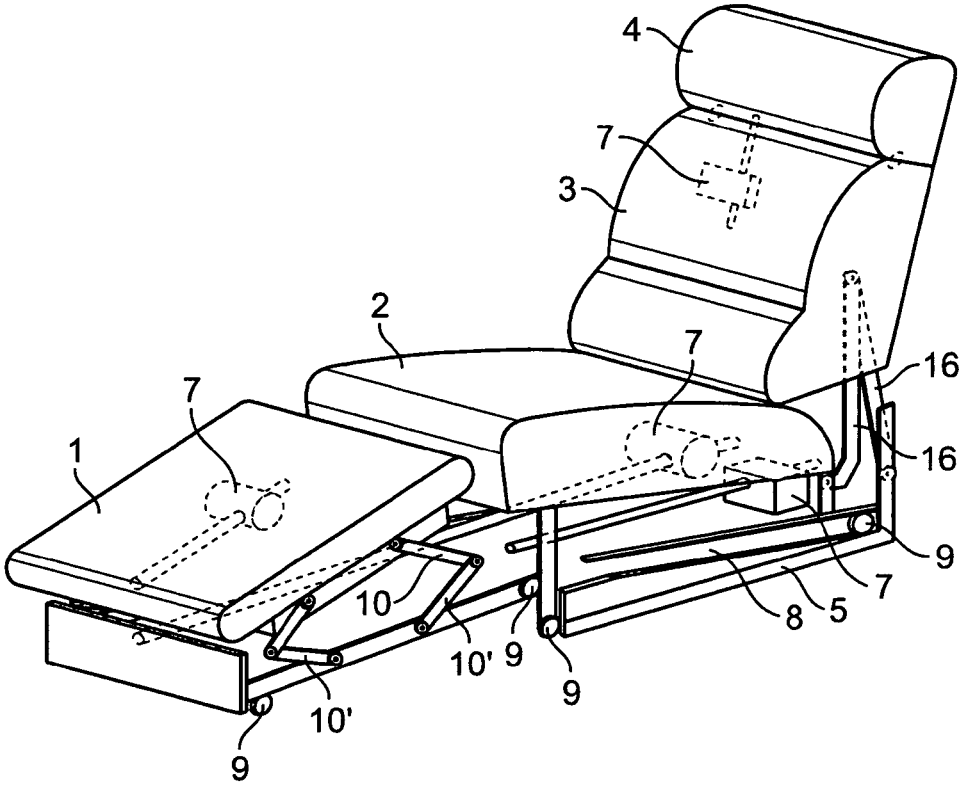
FIG. 3 shows the piece of upholstered furniture with the footrest raised and angled away.
Figure 4:
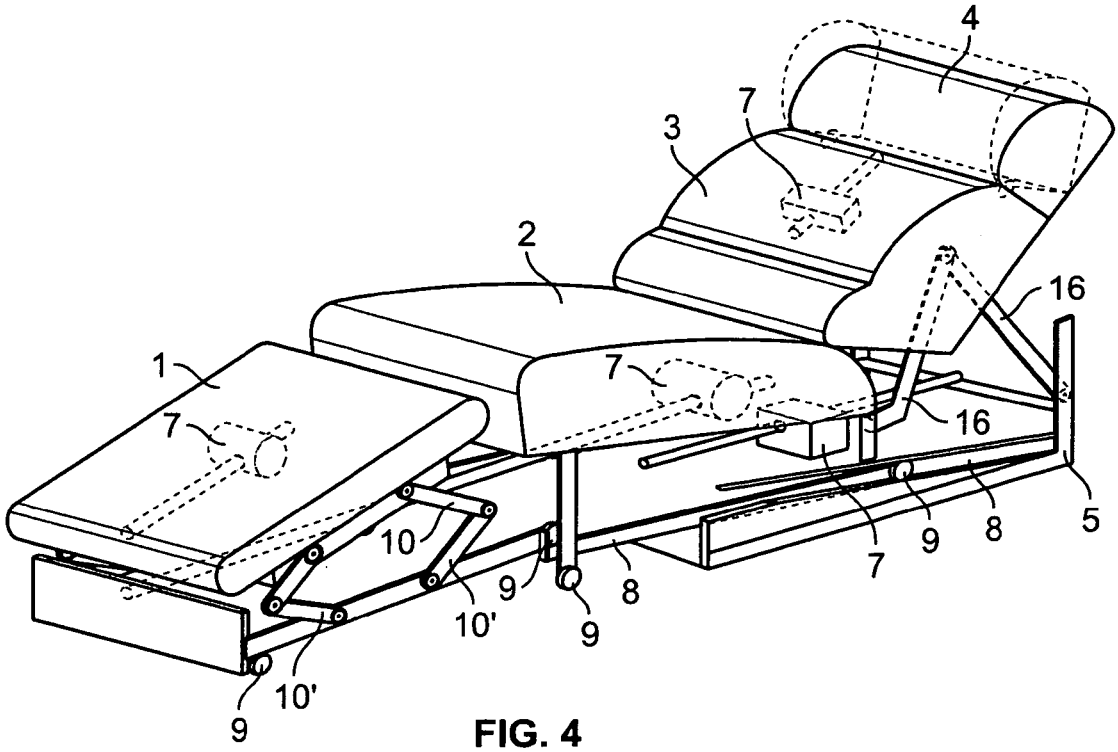
FIG. 4 shows the piece of upholstered furniture with the seat part partly moved out, the backrest at an angle, with the adjustable headrest, and the footrest raised and angled away.
Figure 5:
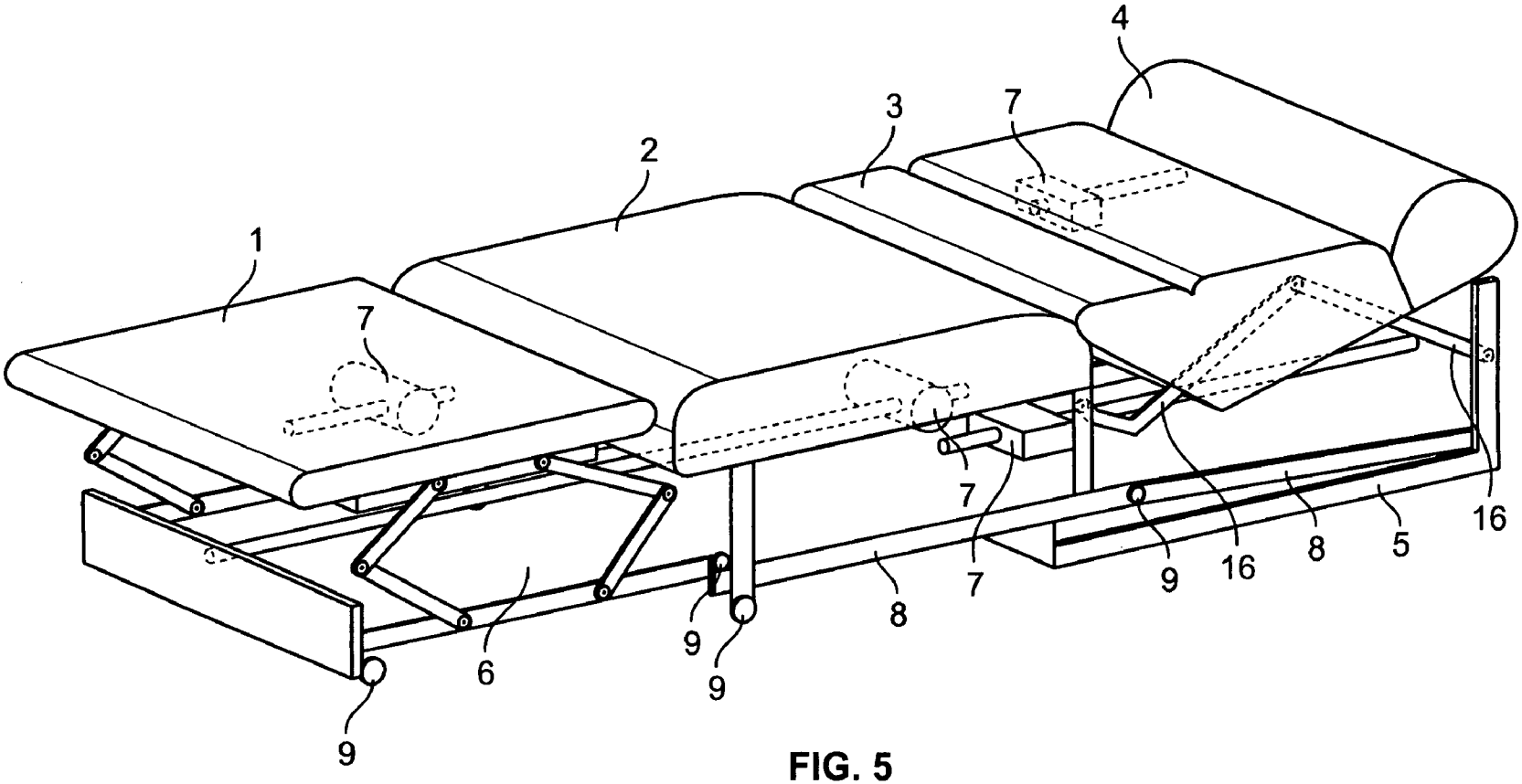
FIG. 5 shows the piece of upholstered furniture converted to a chaise lounge.
Figure 6:
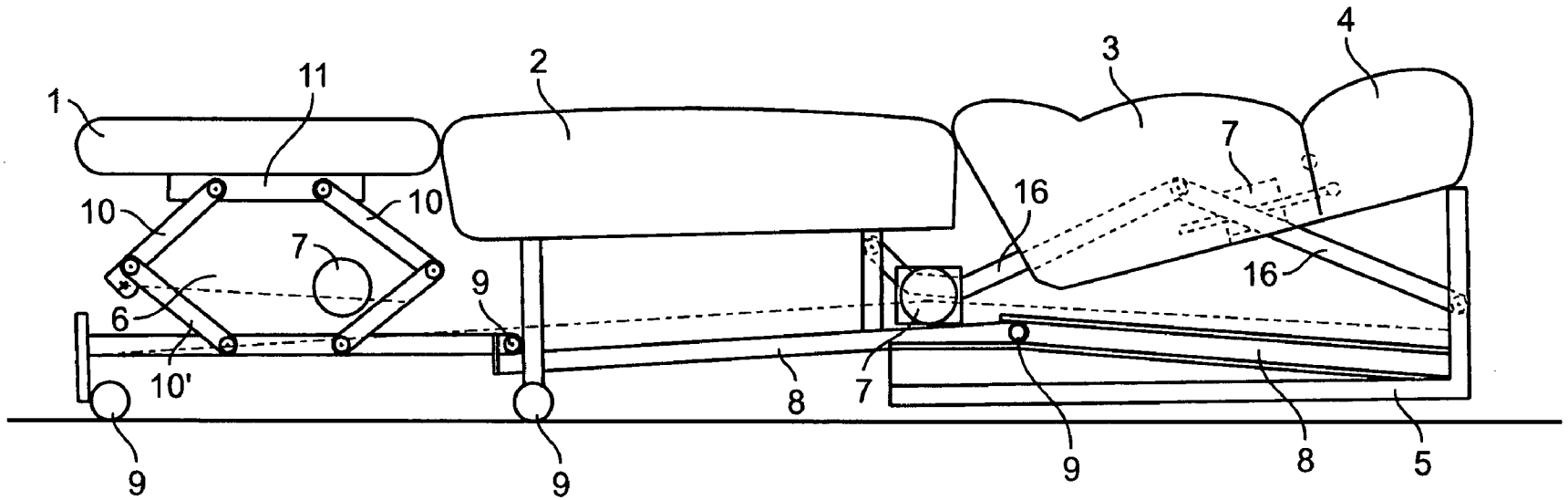
FIG. 6 is a side view basically showing an embodiment of the invention in which the footrest and seat part are moved out, and the backrest is in the lying-down position.
Figure 7A:
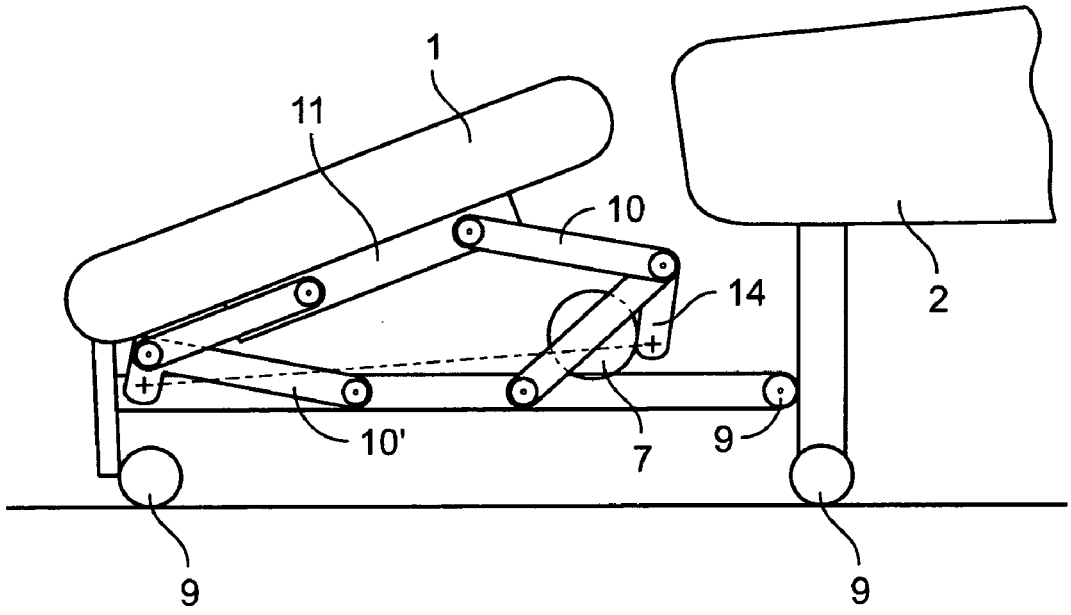
FIG. 7*a* is a side view basically showing the lever construction of the footrest shown in FIG. 6 in the angled position.
Figure 7B:
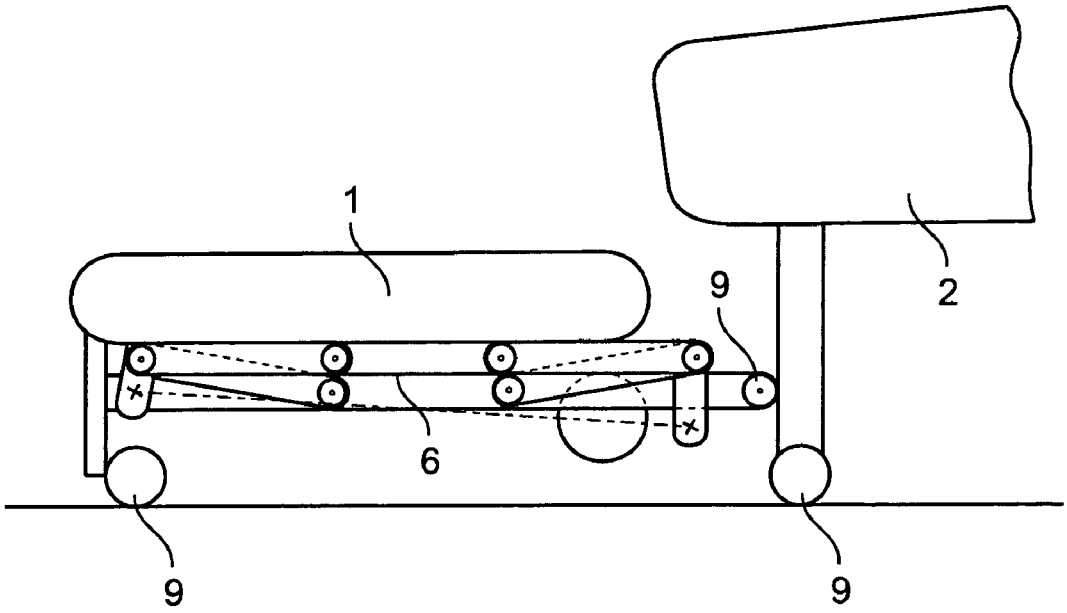
FIG. 7*b* is a side view basically showing the lever construction of the footrest shown in FIG. 6 in the moved-in position.

Turning now in detail to the drawings, FIGS. 1–6 show an embodiment of the convertible piece of furniture which possesses a chair function and a chaise lounge function, with a plurality of intermediate positions. Each movable part of the piece of upholstered furniture can be changed by means of a motor drive having a control.

The convertible piece of furniture includes a footrest 1, a seat part 2, a backrest 3, and a headrest 4. Footrest 1 and seat part 2 are configured so that they can move out of a base frame 5 with their metal fittings. Footrest 1 is adjustable in height and angle by means of a lever construction 6 that is arranged on the metal fitting of footrest 1 and by means of a motor drive 7. Footrest 1 can first be adjusted into a slanted position and the slanted position can be changed, in a continuous or step-less manner, into a horizontal position at the seat height, and finally, into a position with a slight upward incline, from the view of seat part 2.

The convertible piece of upholstered furniture is characterized by a complete conversion of a chair into a chaise lounge or a bed, whereby no gaps or cracks are formed between the movable individual parts that then form the lying-down surface, a step-less adjustment is possible in all intermediate positions, even under the stress of a person, and furthermore, in particular, a step-less angle adjustment of the footrest is possible. When the chair function is being set, all of the parts that can move out are covered and not evident as such. Even during the conversion into a different chair position or into the lying-down position, all of the metal fittings are covered. It is not possible to reach into moving parts, and therefore there is no risk of injury.

This feature is achieved, for example in the case of footrest 1, by means of a bellows that is arranged between the upholstery of footrest 1 and the metal fittings of footrest 1. In order to implement the individual functions, the metal fitting of the individual parts, footrest 1, seat part 2, etc., are implemented as follows.

The piece of upholstered furniture stands on a base frame 5. On the right and the left, in the side region, in each instance, there is a guide rail 8, which rises slightly towards the front. The rear support wheels 9 of seat part 2 run in these guide rails 8 of base frame 5. Seat part 2 possesses analogous guide rails 8 for rear support wheels 9 of footrest 1, also in the side regions. Front support wheels 9 of seat part 2 and of footrest 1, in each instance, run on the floor.

By means of at least one motor 7 having a telescoping mechanism, seat part 2 and footrest 1 can be moved out of base frame 5. At the same time, backrest 3 possesses a motor 7 on the back. The individual motors 7 are activated in coordination with one another. When footrest 1 and seat part 2 are moved out, backrest 3 is also moved down.

Figure 8:
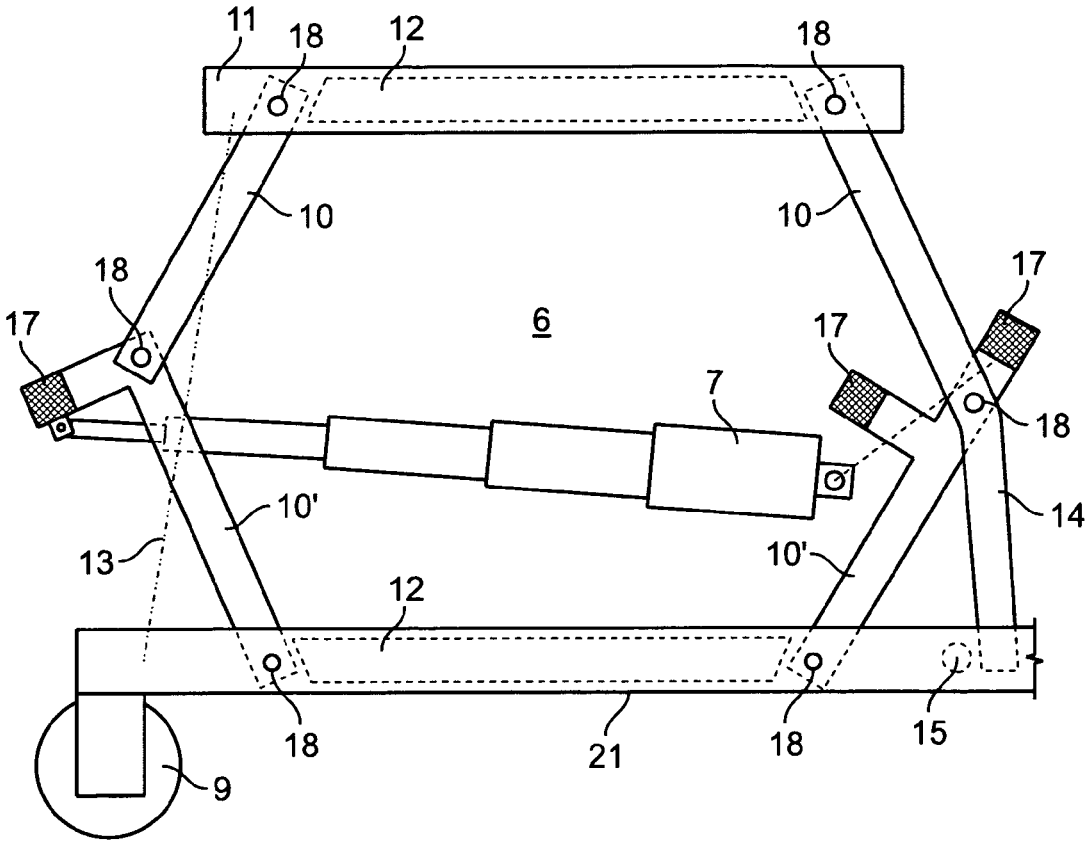
FIG. 8 is a side view of the lever construction shown in FIG. 6, in the moved-out position.

Footrest 1 possesses a lever construction 6 between the upholstery and the metal fitting, to produce a slanted position and for a height adjustment. Lever construction 6 is mounted on the metal fitting of footrest 1 and is made up of bracket elements 10 that can be moved in scissors-like manner and are mounted at the ends, preferably made of flat material, on both outer sides. As shown in FIG. 8, the bracket elements 10 and 10' are mounted at their ends at the pivots or points of rotation 18. The bottom bracket elements 10 each possess a connection 17 by means of profile material, to the other side and the analogous bracket elements 10, 10' located there. Between these two connections 17, a motor 7 having a telescoping cylinder is arranged, which implements the movement of lever construction 6.

First, the upholstery of the footrest 1 is brought into a slanted position and subsequently, the slanted position can be brought into the horizontal, and further into a position with a slight upward incline, viewed from seat part 2, in step-less manner.

The top ends of bracket elements 10 are mounted in a support frame 11 for the upholstery of the footrest 1, and the bottom ends of bracket elements 10' are mounted in the bottom frame 21 of footrest 1. Trapezoid-shaped stops 12 are arranged between the bottom bearing points of bracket elements 10' in the metal fitting of footrest 1 and between the top bearing points of the bracket elements 10 on support frame 11 for the upholstery of footrest 1. These stops 12 delimit the outward movement of lever construction 6.

A tension spring 13 is arranged between support frame 11 for the upholstery of footrest 1 and the metal fitting of footrest 1. This tension spring 13 facilitates the collapsing of lever construction 6, at least when lever construction 6 is being moved back from its maximum position. When using a very stiff bellows, it might be possible to do without this tension spring 13.

One of the top bracket elements 10 possesses an extension to the metal fitting of the footrest as a stop 14. The metal fitting of footrest 1 possess a counter-stop 15 at the corresponding location, when lever construction 6 is moved out to its maximum position.

The movement of backrest 3 takes place by way of a metal fitting that possesses a boomerang-like flat material 16 on the metal fitting of seat part 2 and on base frame 5, in each instance, on the right and the left, in each instance, in the side region of the piece of upholstered furniture, and is mounted there. Both flat material metal fitting parts 16 are mounted on a common point on the outside of backrest 3. A motor 7 having a telescoping mechanism or a pinion, which is attached to base frame 5 and with the telescoping mechanism on backrest 3, allows a step-less movement of backrest 3.

Backrest 3 possesses a frame, as the top end towards the headrest 4, which frame forms an angle to the base of the piece of upholstered furniture. At the side of the frame that stands higher in the direction of seat part 2, at least one hinge is attached, which holds headrest 4. At the bottom frame of headrest 4, a bracket is attached, the free end of which carries an axle on which a pinion driven by a motor 7 engages. Motor 7 is attached to backrest 3.

All the motors 7 can be controlled by way of a remote control.

Although only a few embodiments of the present invention have been shown and described, it is to be understood that many changes and modifications may be made thereunto without departing from the spirit and scope of the invention as defined in the appended claims.

What is claimed is:

1. A convertible piece of upholstered furniture comprising:

(a) a plurality of movable upholstered parts comprising a seat, a backrest, a headrest and a footrest;

(b) a plurality of respective arrangements of lever constructions and motorized conversion aids for adjusting said seat, said backrest, said headrest, and said footrest to a plurality of positions comprising a chair function position, a chaise lounge function position, and a plurality of intermediate positions, said backrest and said headrest being adjustable without causing said backrest and said headrest to contact a wall adjacent to said piece of upholstered furniture, one of said lever constructions being arranged on a bottom frame of said footrest for adjusting height and angle of said footrest; and (c) a support frame for said footrest;

wherein said piece of upholstered furniture is adjustable even when being used by a person and said plurality of arrangements comprises at least one motor drive having a control for adjusting each movable part of said piece of upholstered furniture;

wherein said at least one motor drive comprises a motor drive for adjusting said footrest into a slanted position, for subsequently adjusting said footrest in a continuous motion into a horizontal position level with seat height, and for thereafter adjusting said footrest into an upwardly inclined position relative to said seat;

wherein said lever construction arranged on said footrest comprises two bracket elements mounted at each outer side of said piece of upholstered furniture, each of said bracket elements comprising a bottom bracket element mounted in the bottom frame of said footrest and a top bracket element mounted in said support frame, two profiles, each profile making a connection between a respective bottom bracket element and a corresponding bottom bracket element on an opposite side of said piece of upholstered furniture, and a motor having a telescoping cylinder arranged between said connections;

wherein one of the top bracket elements comprises a stop comprising an extension to the lever construction of said footrest, and the bottom frame of said footrest comprises a counter-stop at a corresponding location for determining a maximum position of movement of said lever construction.

2. The convertible piece of upholstered furniture according to claim 1 further comprising a base frame wherein said footrest and said seat are movable with their respective lever constructions out of said base frame.

3. The convertible piece of upholstered furniture according to claim 2 further comprising:

(a) a plurality of guide rails arranged parallel to sides of said piece of upholstered furniture comprising seat guide rails arranged on said seat and base frame guide rails in said base frame; and (b) a plurality of support wheels comprising two front footrest support wheels arranged in front corners of said footrest, two rear footrest support wheels arranged in rear corners of said footrest, two front seat support wheels arranged in front corners of said seat, and two rear seat support wheels arranged in rear corners of said seat;

wherein said two front footrest support wheels and said two front seat support wheels are adapted to stand on a floor surface, said two rear footrest support wheels are guided in said seat guide rails, and said two rear seat support wheels are guided in said base frame guide rails; and wherein the lever construction for said footrest is movable out of the lever construction of said seat and the lever construction of said seat is movable out of said base frame as the lever construction of said footrest moves out of the lever construction of said seat.

4. The convertible piece of upholstered furniture according to claim 1 wherein said backrest is adjustable to a downward position without contact with the wall and said footrest, said seat, and said backrest are adjustable to an end position to form a horizontal lying surface without gaps between said footrest, said seat, and said backrest, and said footrest, said seat, and said backrest are adjustable to a plurality of selected sitting positions.

5. The convertible piece of upholstered furniture according to claim 1 wherein said headrest is adjustable relative to said backrest from a position even with said backrest to a forward or backward position relative to said backrest.

6. The convertible piece of upholstered furniture according to claim 1 further comprising trapezoid-shaped stops arranged between bearing points of the bottom bracket elements in the lever construction of said footrest and between top bearing points of the top bracket elements on said support frame.

7. The convertible piece of upholstered furniture according to claim 1 further comprising a tension spring arranged between said support frame and the lever construction of the footrest.

8. The convertible piece of upholstered furniture according to claim 1 further comprising a base frame wherein said footrest and said seat are movable with their respective lever constructions out of said base frame and a plurality of angled, flat members, each member mounted on the lever construction of said seat and on said base frame on a respective side of said piece of upholstered furniture, said members being mounted at a common point outside said backrest.

9. The convertible piece of upholstered furniture according to claim 1, further comprising a base frame wherein said footrest and said seat are movable with their respective lever constructions out of said base frame, at least one hinge holding said headrest, a brackets an axle carried by said bracket, a motor, and a pinion driven by said motor and engaging said axle;

wherein said backrest comprises a backrest frame at an upper end of said backrest toward said headrest, said backrest frame being disposed at an angle relative to the base frame, said at least one hinge is attached at an upper portion of a side of said backrest frame relative to said seat, and said headrest comprises a bottom frame attached to said bracket.

10. A convertible piece of upholstered furniture comprising:

(a) a plurality of movable upholstered parts comprising a seat, a backrest, a headrest and a footrest;

(b) a plurality of respective arrangements of lever constructions and motorized conversion aids for adjusting said seat, said backrest, said headrest, and said footrest to a plurality of positions comprising a chair function position, a chaise lounge function position, and a plurality of intermediate positions, said backrest and said headrest being adjustable without causing said backrest and said headrest to contact a wall adjacent to said piece of upholstered furniture, one of said lever constructions being arranged on a bottom frame of said footrest for adjusting height and angle of said footrest; and (c) a support frame for said footrest;

wherein said piece of upholstered furniture is adjustable even when being used by a person and said plurality of arrangements comprises at least one motor drive having a control for adjusting each movable part of said piece of upholstered furniture;

wherein said at least one motor drive comprises a motor drive for adjusting said footrest into a slanted position, for subsequently adjusting said footrest in a continuous motion into a horizontal position level with seat height, and for thereafter adjusting said footrest into an upwardly inclined position relative to said seat; and wherein said lever construction arranged on said footrest comprises two bracket elements mounted at each outer side of said piece of upholstered furniture, each of said bracket elements comprising a bottom bracket element mounted in the bottom frame of said footrest and a top bracket element mounted in said support frame, two profiles, each profile making a connection between a respective bottom bracket element and a corresponding bottom bracket element on an opposite side of said piece of upholstered furniture, and a motor having a telescoping cylinder arranged between said connections.

* * * * *

UNITED STATES PATENT AND TRADEMARK OFFICE

CERTIFICATE OF CORRECTION

PATENT NO. : 7,083,235 B2
APPLICATION NO. : 10/868460
DATED : August 1, 2006
INVENTOR(S) : Grimm et al.

It is certified that error appears in the above-identified patent and that said Letters Patent is hereby corrected as shown below:

Title page, item [75], please change "D-047396" to correctly read:

--D-04736--.

In Column 8, line 5, (Line 5 of Claim 9), after the word "a" please change "brackets" to correctly read:

--bracket,--.

Signed and Sealed this

Twenty-first Day of November, 2006

JON W. DUDAS
*Director of the United States Patent and Trademark Office*